US005721804A

United States Patent [19]

Greene, III

[11] Patent Number: 5,721,804

[45] Date of Patent: Feb. 24, 1998

[54] Y-SHAPED PORTABLE ELECTRIC SPACE HEATER WITH VALUE TO REDUCE PRESSURE WITHIN THE BOILER

[75] Inventor: Grant G. Greene, III, Lafayette, Colo.

[73] Assignee: Heatech International, Inc., Cheyenne, Wyo.

[21] Appl. No.: 542,317

[22] Filed: Oct. 12, 1995

[51] Int. Cl.[6] ..... H05B 1/02; F24H 3/08; F24D 13/04

[52] U.S. Cl. ..... 392/358; 392/367; 392/403; 126/101; 237/16; 237/79

[58] Field of Search ..... 392/357–359, 392/377, 398, 403; 237/16; 126/101; 165/175, 104.32, 104.23, DIG. 527, DIG. 500, DIG. 485, 104.14, 104.13, 173; 122/DIG. 1

[56] References Cited

U.S. PATENT DOCUMENTS

| | | | |
|---|---|---|---|
| 1,043,922 | 11/1912 | Gold . | |
| 1,241,244 | 9/1917 | Palmer | 392/358 |
| 1,289,052 | 12/1918 | Allensby . | |
| 1,866,221 | 7/1932 | Pennington . | |
| 1,913,923 | 6/1933 | Freeman . | |
| 1,919,204 | 7/1933 | Decker . | |
| 1,929,365 | 10/1933 | Mautsch | 165/DIG. 485 |
| 1,983,437 | 12/1934 | Carr . | |
| 2,276,407 | 3/1942 | Manzer . | |
| 2,432,917 | 12/1947 | Maurer . | |
| 2,481,963 | 9/1949 | Witte et al. . | |
| 2,492,774 | 12/1949 | Wild . | |
| 2,509,138 | 5/1950 | Dorn . | |
| 2,594,101 | 4/1952 | Volker . | |
| 2,712,054 | 6/1955 | King | 392/358 |
| 2,745,941 | 5/1956 | McElhaney | 392/357 |
| 2,765,393 | 10/1956 | Theisen . | |
| 2,772,073 | 11/1956 | Reynolds et al. . | |
| 2,866,073 | 12/1958 | Omohundro . | |
| 2,979,311 | 4/1961 | Bungas | 392/357 |
| 3,179,788 | 4/1965 | Uhlig . | |
| 3,281,574 | 10/1966 | Heiman . | |
| 3,337,715 | 8/1967 | Finn . | |
| 3,463,904 | 8/1969 | Pauls . | |
| 3,469,075 | 9/1969 | Barbier . | |
| 3,523,180 | 8/1970 | Kennedy . | |
| 3,640,456 | 2/1972 | Sturgis . | |
| 3,927,299 | 12/1975 | Sturgis . | |
| 3,941,311 | 3/1976 | McNeely . | |
| 4,223,205 | 9/1980 | Sturgis . | |
| 4,518,847 | 5/1985 | Horst, Sr. et al. . | |
| 4,567,351 | 1/1986 | Kitagawa et al. | 392/357 |
| 4,791,274 | 12/1988 | Horst | 392/357 |

FOREIGN PATENT DOCUMENTS

| | | | |
|---|---|---|---|
| 2161279 | 4/1973 | Germany | 165/175 |
| 2523305 | 1/1976 | Germany . | |
| 2447057 | 4/1976 | Germany | 165/173 |

*Primary Examiner*—Tu B. Hoang
*Attorney, Agent, or Firm*—Dorr, Carson, Sloan & Birney, P.C.

[57] ABSTRACT

A space heater employs a generally Y-shaped housing. A boiler within the housing contains a working fluid at sub-atmospheric pressure when at ambient temperature. This reduces the boiling point of working fluid. A series of heat exchangers are mounted in the branch portions of the housing and connected to receive working fluid from the boiler. A blower directs ambient air between the heat exchangers and through the front openings of the housing. A valve can be operated to release pressure from within the boiler and heat exchangers. An electric heating element heats the working fluid within the boiler to a temperature above the boiling point under normal operating conditions. During initial manufacture or repair of the unit, the heating element is activated to heat the working fluid while the valve is open, and then deactivated with the valve is closed to allow the working fluid to cool, thereby creating reduced pressure within the boiler. In the preferred embodiment, the boiler and heat exchangers are die-cast as a single unit to reduce costs and increase durability. The heating element is threaded into the boiler to reduce costs and simplify replacement.

13 Claims, 2 Drawing Sheets

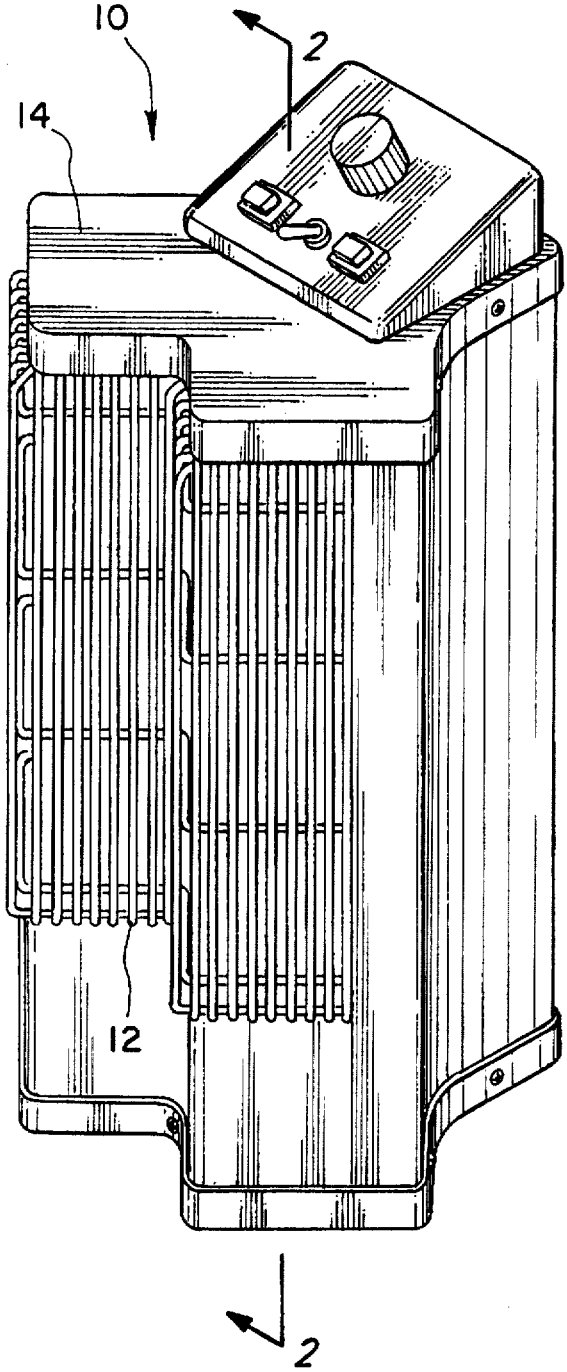
Fig. 1
Fig. 2
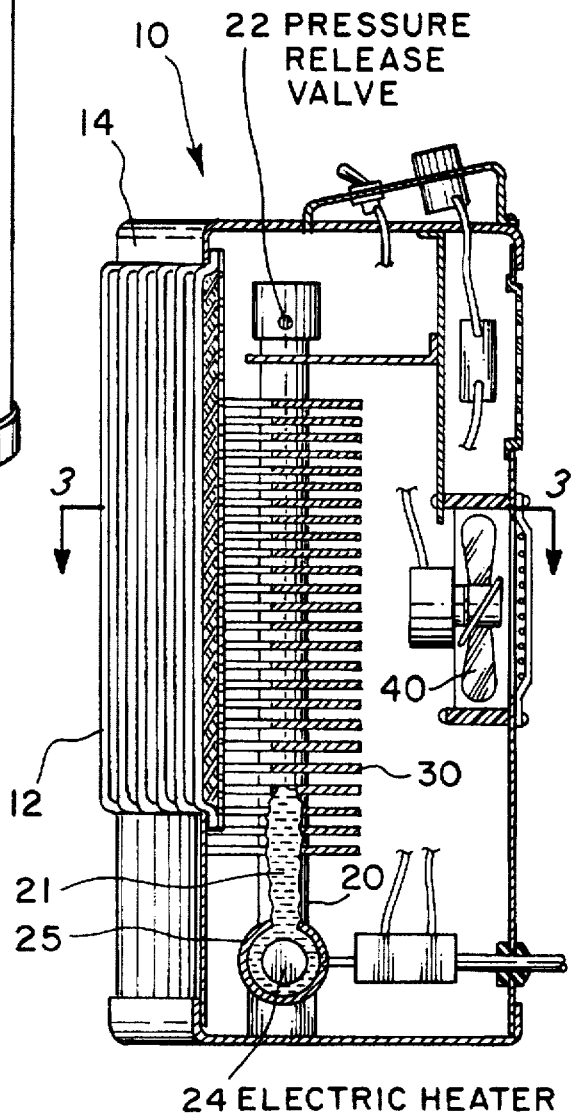

Y-SHAPED PORTABLE ELECTRIC SPACE HEATER WITH VALUE TO REDUCE PRESSURE WITHIN THE BOILER

BACKGROUND OF THE INVENTION

1. Field of the Invention

The present invention relates generally to the field of space heaters. More specifically, the present invention discloses an electrically-powered portable space heater in which the working fluid is initially placed under subatmospheric pressure to reduce its boiling point by activating the heating element while opening a pressure-release valve, and then closing the valve before the working fluid is allowed to cool.

2. Statement of the Problem

Electrically-powered space heaters have been widely used for many years. Many space heaters use electrical resistance coils that directly heat the surrounding air. Other examples in the prior art use an electrical heating element to heat a working fluid contained in a boiler. The working fluid boils and carries heat to a heat exchanger, which heats the surrounding air.

Some electric space heaters employ a boiler containing a working fluid maintained at subatmospheric pressure at normal ambient temperatures. This reduces the boiling point of the working fluid. For example, it is possible to reduce the boiling point of the working fluid by as much as 100° F. This shortens the response time for the boiler, reduces the steady-state operating temperature necessary to transfer a given amount of heat to the surrounding room, and also lowers the steady-state operating pressure for the boiler. Reduced temperature and pressure also make the system safer, particularly in the event of leakage from the boiler or heat exchangers.

The boiler and heat exchanger have conventionally been fabricating by brazing or soldering discrete components together, and then drawing a partial vacuum before the boiler is sealed. For example, the boiler is often made of copper tubing. The portion of the heat exchanger that contains the working fluid is also often made of copper tubing. A large number of thin aluminum fins are mechanically attached to the exterior of the heat exchanger tubes to increase the surface area for heat transfer with the surrounding air.

This approach inherently suffers from a number of disadvantages. First, the costs of manufacturing, assembling, and testing are substantial due to the subatmospheric pressure that must be maintained within the boiler and heat exchangers. Each joint must be separately brazed or soldered, and then tested to ensure that there are no leaks. This is relatively time consuming and require extensive use of skilled labor. In addition, the heat exchanger fins are usually separately fabricated and then attached to each of the heat exchange tubes. Second, the resulting joints can break or leak unless they are handled with great care. Third, the heating element is usually sealed within the boiler by brazing. This makes its difficult to replace the heating element if it fails. The unit must be returned to the factory to replace the heating element and then reseal the boiler under a partial vacuum.

The following are examples of electric space heaters that have been invented in the past:

| Inventor | Patent No. | Issue Date |
|---|---|---|
| Gold | 1,043,922 | Nov. 12, 1912 |
| Allensby | 1,289,052 | Dec. 24, 1918 |
| Pennington | 1,866,221 | July 5, 1932 |
| Freeman | 1,913,923 | June 13, 1933 |
| Decker | 1,919,204 | July 25, 1933 |
| Carr | 1,983,437 | Dec. 4, 1934 |
| Manzer | 2,276,407 | Mar. 17, 1942 |
| Mauer | 2,432,917 | Dec. 16, 1947 |
| Witte et al. | 2,481,963 | Sep. 13, 1949 |
| Wild | 2,492,774 | Dec. 27, 1949 |
| Dorn | 2,509,138 | May 23, 1950 |
| Volker | 2,594,101 | Apr. 22, 1952 |
| Theisen | 2,765,393 | Oct. 2, 1956 |
| Reynolds et al. | 2,772,342 | Nov. 27, 1956 |
| Omohundro | 2,866,073 | Dec. 23, 1958 |
| Uhlig | 3,179,788 | Apr. 20, 1965 |
| Heiman | 3,281,574 | Oct. 25, 1966 |
| Finn | 3,337,715 | Aug. 22, 1967 |
| Pauls | 3,463,904 | Aug. 26, 1969 |
| Barbier | 3,469,075 | Sep. 23, 1969 |
| Kennedy | 3,523,180 | Aug. 4, 1970 |
| Sturgis | 3,640,456 | Feb. 8, 1972 |
| Sturgis | 3,927,299 | Dec. 16, 1975 |
| McNeely | 3,941,311 | March 2, 1976 |
| Sturgis | 4,223,205 | Sep. 16, 1980 |
| Horst et al. | 4,518,847 | May 21, 1985 |

Horst et al. disclose the most relevant prior art. This patent discloses a portable electrically-powered space heater having a boiler containing a working fluid. Two upstanding heat exchangers are housed within a Y-shaped housing with a fan located in the stem portion of the housing to distribute a curtain of warm air. Space heaters covered by this patent were previously sold by Techno-Therm, Inc. of Denver, Colo. Although not expressed disclosed in the patent to Horst et al., the units sold by Techno-Therm, Inc. were assembled by brazing and soldering discrete components of copper tubing. A series of fins are mechanically attached around the exterior of each heat exchanger tube. Subatmospheric pressure within the boiler depresses the boiling point of the working fluid. The reduced pressure is created by connecting the boiler and heat exchangers to a vacuum pump during fabrication. This makes it very difficult to repair units in the field. As a practical matter, any units that leak or require a new heating elements must be returned to the factory for service.

Gold discloses another example of an electric heating system that heats a working fluid under a partial vacuum to promote more rapid vaporization of the working fluid and thereby accelerate heat transfer.

McNeely discloses a heating unit that uses a two-phase liquid as the working fluid. A slight vacuum is pulled through a valve 28 to depress the boiling point of the working fluid.

Decker, Sturgis, Dorn, Manzer, Mauer, Reynolds et al., Barbier, Carr, Uhlig, and Pauls disclose other examples of electric space heaters that employ a working fluid.

Witte et al., Volker, Theisen, Omohundro, Kennedy and Wild disclose examples of electric space heaters having a fan or blower.

Pennington and Freeman disclose examples of electrically-powered steam radiators.

Heiman discloses an electrical heater using a pressurized working fluid to minimize start-up noise and vibration.

Allensby discloses a steam-heated radiator.

Finn discloses an electrically-heated sauna stove.

3. Solution to the Problem

None of the prior art references uncovered in the search show a portable electric space heater that uses the heating element and a pressure-release valve to create subatmospheric pressure within the boiler, and thereby reduce the boiling point of the working fluid within the boiler. This substantially reduces manufacturing and repair costs that would otherwise be associated with maintaining subatmospheric pressure within the boiler.

In addition, the die-cast construction of the present invention overcomes many of the problems associated with the prior art by substantially reducing the costs of manufacturing, assembling, and testing the boiler and heat exchangers for the space heater. Die-cast construction is much stronger and greatly reduces the chance of joint failure or leakage. In addition, the present invention allows the fins to cast as a single component with the boiler and heat exchanger tubes, which provides greater flexibility in designing the fins to maximize heat transfer within the housing of the space heater.

SUMMARY OF THE INVENTION

This invention provides a portable electric space heater that employs a generally Y-shaped housing. A boiler within the housing contains a working fluid at subatmospheric pressure when at ambient temperature. This reduces the boiling point of working fluid. A series of heat exchangers are mounted in the branch portions of the housing and connected to receive working fluid from the boiler. A blower directs ambient air between the heat exchangers and through the front openings of the housing. A valve can be operated to release pressure from within the boiler and heat exchangers. An electric heating element heats the working fluid within the boiler to a temperature above the boiling point under normal operating conditions. During initial manufacture or repair of the unit, the heating element is activated to heat the working fluid while the valve is open, and then deactivated with the valve is closed to allow the working fluid to cool, thereby creating reduced pressure within the boiler. In the preferred embodiment, the boiler and heat exchangers are die-cast as a single unit to reduce costs and increase durability. The heating element is threaded into the boiler to reduce costs and simplify replacement.

A primary object of the present invention is to provide a portable electrically-power space heater that can be manufactured and repaired more easily and at lower cost.

Another object of the present invention is to provide a portable electrically-powered space heater that is more rugged and less likely to leak or break.

Yet another object of the present invention is to provide a portable electrically-powered space heater having improved heat transfer characteristics.

These and other advantages, features, and objects of the present invention will be more readily understood in view of the following detailed description and the drawings.

BRIEF DESCRIPTION OF THE DRAWINGS

The present invention can be more readily understood in conjunction with the accompanying drawings, in which:

FIG. 1 is a perspective view of the electric space heater.

FIG. 2 is a side cross-sectional view of the boiler and one of the heat exchangers with a portion of the housing cut away.

DETAILED DESCRIPTION OF THE INVENTION

Figure 3:
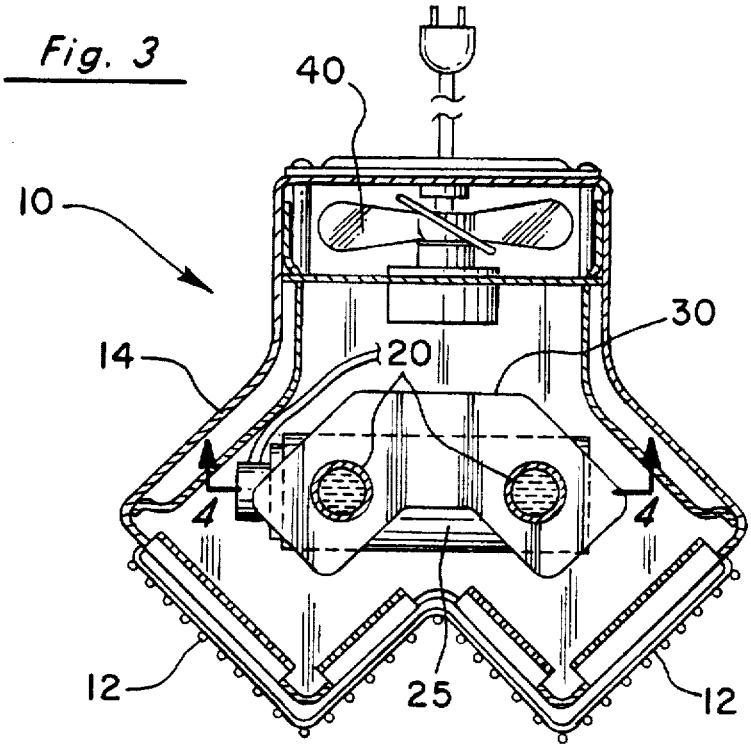
FIG. 3 is cross-sectional view of the electric space heater showing the housing, fan, and heat exchangers.

Turning to FIG. 1, a front perspective view is provided of the exterior housing 14 of the electric heater 10. FIG. 2 is a corresponding side cross-sectional view of the boiler 25 and one of the heat exchangers 20 with a portion of the housing 14 cut away. FIG. 3 is cross-sectional view of the electric space heater showing the housing, fan, and heat exchangers. As shown in FIGS. 1 and 3, the housing 14 is generally Y-shaped with a stem portion and angled side walls that define a generally Y-shaped transverse cross-section. The stem portion is located at the rear of the unit. At least two divergent branch portions open toward the front of the unit. A grill 12 covers the front openings in the housing 14.

Figure 4:
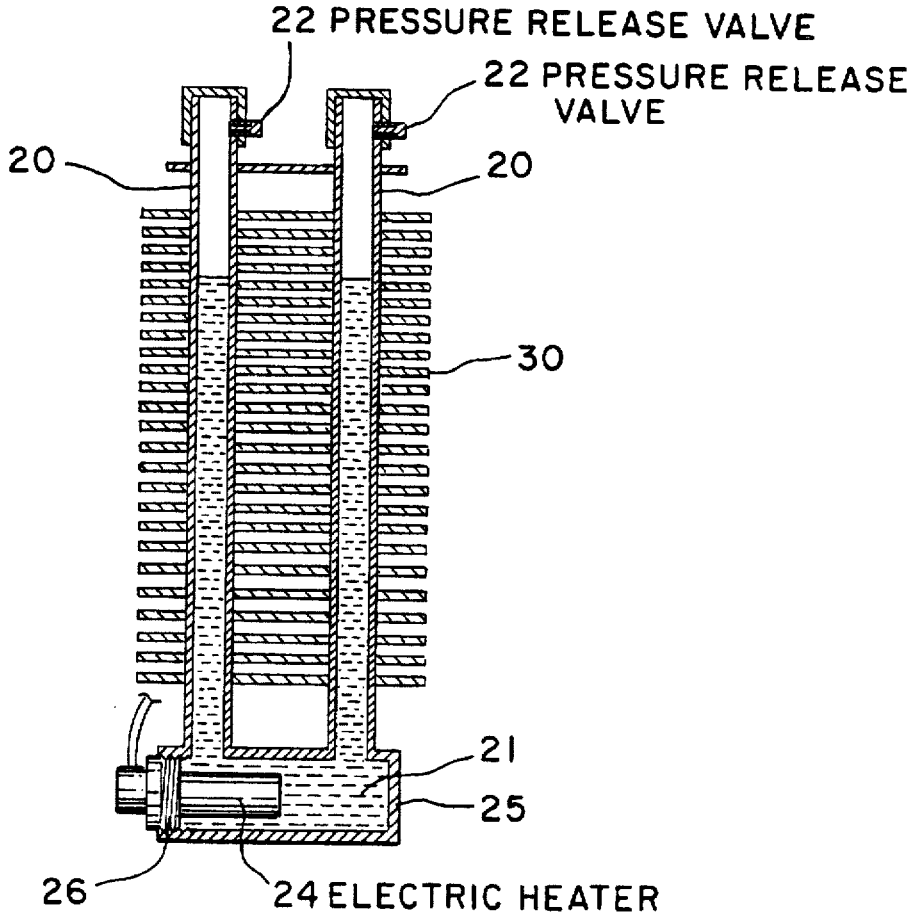
FIG. 4 is another cross-sectional view of the boiler and heat exchangers within the housing of the space heater.

FIG. 4 is another cross-sectional view of the boiler 25 and heat exchanger tubes 20 within the housing 14 of the space heater 10. In the preferred embodiment, the boiler 25 is die cast from aluminum. A number of heat exchanger tubes 20 (or risers) extend upward from the boiler 25 into the branch portions of the housing 14. A series of fins 30 extend outward from the heat exchanger tubes 20 to increase the effective heat transfer to the surrounding air. Preferably, the fins 30 extend continuously between adjacent heat exchanger tubes 20 and also occupy a substantial portion of the branches within the housing 14 to increase the effective surface area for heat transfer. The boiler 25, heat exchanger tubes 20, and fins 30 can be die cast as single piece during construction to reduce manufacturing costs and decrease any chance of a leak. Here again, aluminum is the material of choice due to its relatively low melting point, low cost, and ease of casting. In addition, cast aluminum tends to have a rougher surface that increases the heat transfer to the surrounding air.

The boiler 25 contains a working fluid 21, such as water or a mixture of water and ethylene glycol. The working fluid 21 is held under subatmospheric pressure when at ambient temperature to reduce the boiling point of the working fluid. This causes the working fluid 21 to begin boiling more quickly after the heater is turned on, and thereby increases heat transfer to the surrounding space sooner.

An electric heating element 24 heats the working fluid 21 within the boiler 25 to a temperature above its boiling point. Working fluid vapor is carried from the boiler 25 into the heat exchanger tubes 20, where the vapor cools, condenses, and flows back into the boiler 25. In the preferred embodiment, the heating element 24 is removably threaded into an opening in the boiler 25. The threads 26 allow the boiler assembly to be more easily assembled, and also simplify repair if it becomes necessary to replace to the heating element.

A fan or blower 40 draws ambient air into the rear of the housing 14, and directs the flow across the heat exchanger tubes 20 and fins 30 and outward through the front openings of the housing 14. The generally Y-shaped cross-section of the housing causes the flow of warm air to be dispersed at the front of the heater in a relatively wide angular pattern. This helps to heat the room evenly and minimizes drafts and cold spots.

The heat exchanger tubes 20 also include a valve 22 that can be manually operated to release pressure from within the boiler 25 and heat exchanger tubes 20. For example, the pressure-release valve 22 can be a Schrader valve or a pet cock valve. After the heating unit has been initially assembled at the factory, the heating element 24 is activated to heat the working fluid 21 within the boiler 24 while the pressure-release valve 22 is held in its open position. The heating element 24 is then deactivated with the valve 22 closed to allow the working fluid 21 to cool. This process creates reduced pressure within the boiler 25 and heat exchanger tubes 20 that depresses the boiling point of the working fluid 21, as previously described.

This process can also be employed if the boiler assembly needs to be repaired at a later date. The valve 22 is opened to allow air to flow into the boiler 25 to equalize pressure. The boiler 25 can then be easily opened by unthreading the heating element 24. After repairs have been completed, subatmospheric pressure is restored within the boiler assembly by activating the heating element 24 to heat the working fluid 21 while the pressure-release valve 22 is held in its open position, and then closing the valve 22 while the working fluid 21 cools.

The above disclosure sets forth a number of embodiments of the present invention. Other arrangements or embodiments, not precisely set forth, could be practiced under the teachings of the present invention and as set forth in the following claims.

I claim:

1. A space heater comprising:

a housing having a front opening;

a unitary die-cast boiler having an integral heat exchanger within said housing;

a working fluid under subatmospheric pressure within said boiler when at ambient temperature to reduce the boiling point of said working fluid;

a valve operable for releasing pressure from within said boiler;

an electric heating element for heating said working fluid within said boiler to a temperature above said boiling point, said heating element being activated to heat said working fluid while said valve is open, and then deactivated with said valve is closed to allow said working fluid to cool, thereby creating said reduced pressure within said boiler; and a blower for directing ambient air across said heat exchanger and through said front opening of said housing.

2. The space heater of claim 1 wherein said valve comprises a pet cock valve.

3. The space heater of claim 1 wherein said valve comprises a Schrader valve.

4. The space heater of claim 1 wherein said boiler and heat exchanger are made of aluminum.

5. The space heater of claim 1 wherein said heat exchangers are die-cast as one piece with a plurality of fins extending between said heat exchangers.

6. The space heater of claim 1 wherein said heating element is removably threaded into said boiler.

7. A space heater comprising:

a housing having angled side walls cooperating with one another in assembled relation to define a generally Y-shaped transverse section with a stem-forming portion at the rear and a plurality of divergent branch portions opening toward the front thereof;

a unitary die-cast boiler having a plurality of integral heat exchangers mounted, respectively, within said branch portions of said housing;

a working fluid under subatmospheric pressure within said boiler when at ambient temperature to reduce the boiling point of said working fluid;

a valve operable for releasing pressure from within said boiler;

an electric heating element for heating said working fluid within said boiler to a temperature above said boiling point, said heating element being activated to heat said working fluid while said valve is open, and then deactivated with said valve is closed to allow said working fluid to cool, thereby creating said reduced pressure within said boiler; and a blower for directing ambient air between said heat exchangers in heat exchange relation thereto and through said front openings of said housing.

8. The space heater of claim 7 wherein said heat exchangers are die-cast as one piece with a plurality of fins extending between said heat exchangers.

9. The space heater of claim 8 wherein said heat exchangers and fins are made of aluminum.

10. The space heater of claim 7 wherein said heating element is removably threaded into said boiler.

11. A space heater comprising:

a housing having angled side walls cooperating with one another in assembled relation to define a generally Y-shaped transverse section with a stem-forming portion at the rear and a plurality of divergent branch portions opening toward the front thereof;

a unitary die-cast boiler within said housing having:

(a) a plurality of integral heat exchanger tubes extending from said boiler into said branch portions of the housing; and (b) a plurality of integral fins extending between said heat exchanger tubes and occupying a portion of said branch portions of said housing;

a working fluid under subatmospheric pressure within said boiler when at ambient temperature to reduce the boiling point of said working fluid;

a valve operable for releasing pressure from within said boiler;

an electric heating element removably secured within said boiler for heating said working fluid within said boiler to a temperature above said boiling point, said heating element being activated to heat said working fluid while said valve is open, and then deactivated with said valve is closed to allow said working fluid to cool, thereby creating said reduced pressure within said boiler; and a blower for directing ambient air around said heat exchanger tubes and fins in heat exchange relation thereto and through said front openings of said housing.

12. The space heater of claim 11 wherein said boiler is made of aluminum.

13. The space heater of claim 11 wherein said heating element is removed secured to said boiler by threads.

* * * * *